US006305957B1

(12) United States Patent
Fink et al.

(10) Patent No.: US 6,305,957 B1
(45) Date of Patent: Oct. 23, 2001

(54) ELECTRICAL CONNECTOR ASSEMBLY

(75) Inventors: Randy L. Fink, Warren, OH (US); Robert W. Rimko, Transfer, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/512,725

(22) Filed: Feb. 24, 2000

(51) Int. Cl.[7] ..... H01R 13/62

(52) U.S. Cl. ..... 439/157

(58) Field of Search ..... 439/157, 160, 439/372, 347, 266

(56) References Cited

U.S. PATENT DOCUMENTS

| | | | | |
|---|---|---|---|---|
| 4,981,440 | * | 1/1991 | Werner et al. | 439/266 |
| 5,681,175 | * | 10/1997 | Busse et al. | 439/157 |
| 5,964,604 | * | 10/1999 | Kashiyama et al. | 439/157 |
| 6,062,882 | * | 5/2000 | Hanazaki et al. | 439/157 |
| 6,132,235 | * | 10/2000 | Kitada | 439/372 |
| 6,168,445 | * | 1/2001 | Seutschniker et al. | 439/157 |

FOREIGN PATENT DOCUMENTS

0938162 A2 1/1999 (EP) .

* cited by examiner

*Primary Examiner*—Paula Bradley
*Assistant Examiner*—James R. Harvey
(74) *Attorney, Agent, or Firm*—Patrick M. Griffin

(57) ABSTRACT

An electrical connector assembly and method for making it. The assembly has a housing and two slides that are slideably supported in the housing spaced apart from the housing's side walls. The slides each include at least one mating slot adapted to receive a mating portion of a mating connector. A slide assist lever is pivotally interconnected with the housing and the slides to move the slides and facilitate mating with the mating connector. The slide assist lever has a first arm and a spaced apart second arm, the first arm extending between the first slide and the adjacent side wall of the housing, and the second arm extending between the second slide and the adjacent side wall of the housing. The connector assembly can be assembled by inserting the arms of the slide assist lever into the housing to a predetermined assembly position; supporting the slide assist lever with a portion of the housing in the assembly position; inserting the slides into the housing; and moving the slide assist lever from the assembly position into engagement with the slides wherein a portion of each arm of the slide assist lever mates with a portion of each slide.

13 Claims, 8 Drawing Sheets

ELECTRICAL CONNECTOR ASSEMBLY

TECHNICAL FIELD

The subject invention relates to high-density electrical connectors of the type that include a mechanical assist, and a method for making it.

BACKGROUND OF THE INVENTION

Those skilled in the field of electrical connectors know of high-density electrical connectors, which involve connections of several wires at the same time. Those persons further know to incorporate a mechanical assist mechanism to draw two mating connectors together, and to retain them. One manufacturer presently utilizes a high-density connector that has a slide assist mechanism. FIG. 1 shows a perspective view of this assembly. The assembly includes a housing, two slides that slide within the housing, and a slide assist lever. The slide assist lever is pivotally mounted on the housing; and is also pivotally attached to each of the slides. In the design shown, the slide assist lever is made from a metal material, and it is heat-staked to the slides. A person can move the slides with respect to the housing by manipulating the slide assist lever. The slides each have camming slots into which portions from a mating connector fit. In operation, the slide assist lever is placed in the forward position and the connector assembly is placed over the mating connector so that the mating portions of the mating connector are disposed in the slots. Then the slide assist lever is moved rearwardly to its locked position. This movement moves the slides, forcing the mating portions of the mating connector through the camming slots. As the mating portions move through the slots, the connector and mating connector draw together until they reach a final, locked position.

This design is satisfactory, but it could be improved. For example, if the connector assembly could be made from parts that simply snap together, this would avoid the need for expensive tools and unnecessary processes.

SUMMARY OF THE INVENTION

An electrical connector assembly for mating with a mating connector comprises a housing having spaced apart side walls; a first slide slideably supported in the housing and spaced inwardly from one of the side walls; and a second slide slideably supported in the housing spaced inwardly from the other of the side walls. The first and second slides each include at least one mating slot adapted to receive a mating portion of the mating connector. A slide assist lever is pivotally interconnected with the housing and each of the slides and is operable to move the slides with respect to the housing to facilitate mating with the mating connector. The slide assist lever has a first arm and a spaced apart second arm, the first arm extending between the first slide and the adjacent side wall of the housing, and the second arm extending between the second slide and the adjacent side wall of the housing. Finally, the housing includes a first pivot pin extending from one side wall and engaging the first arm, and a second pivot pin extending from the other side wall and engaging the second arm.

This connector assembly has advantages over the prior design, including the fact that it is easy to assemble with parts that simply snap together. Also, because the slider arms extend between the housing side walls and the sliders, they are protected from damage.

There is also a corresponding method for assembling an electrical connector that includes a housing for supporting a plurality of wires, first and second slides, and a slide assist lever having arms that are pivotally interconnected with the housing and the slides for moving the slides with respect to the housing. The method includes the steps of: inserting the arms of the slide assist lever into the housing to a predetermined assembly position; supporting the slide assist lever with a portion of the housing in the assembly position; inserting the slides into the housing; and moving the slide assist lever from the assembly position into engagement with the slides wherein a portion of each arm of the slide assist lever mates with a portion of each slide.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
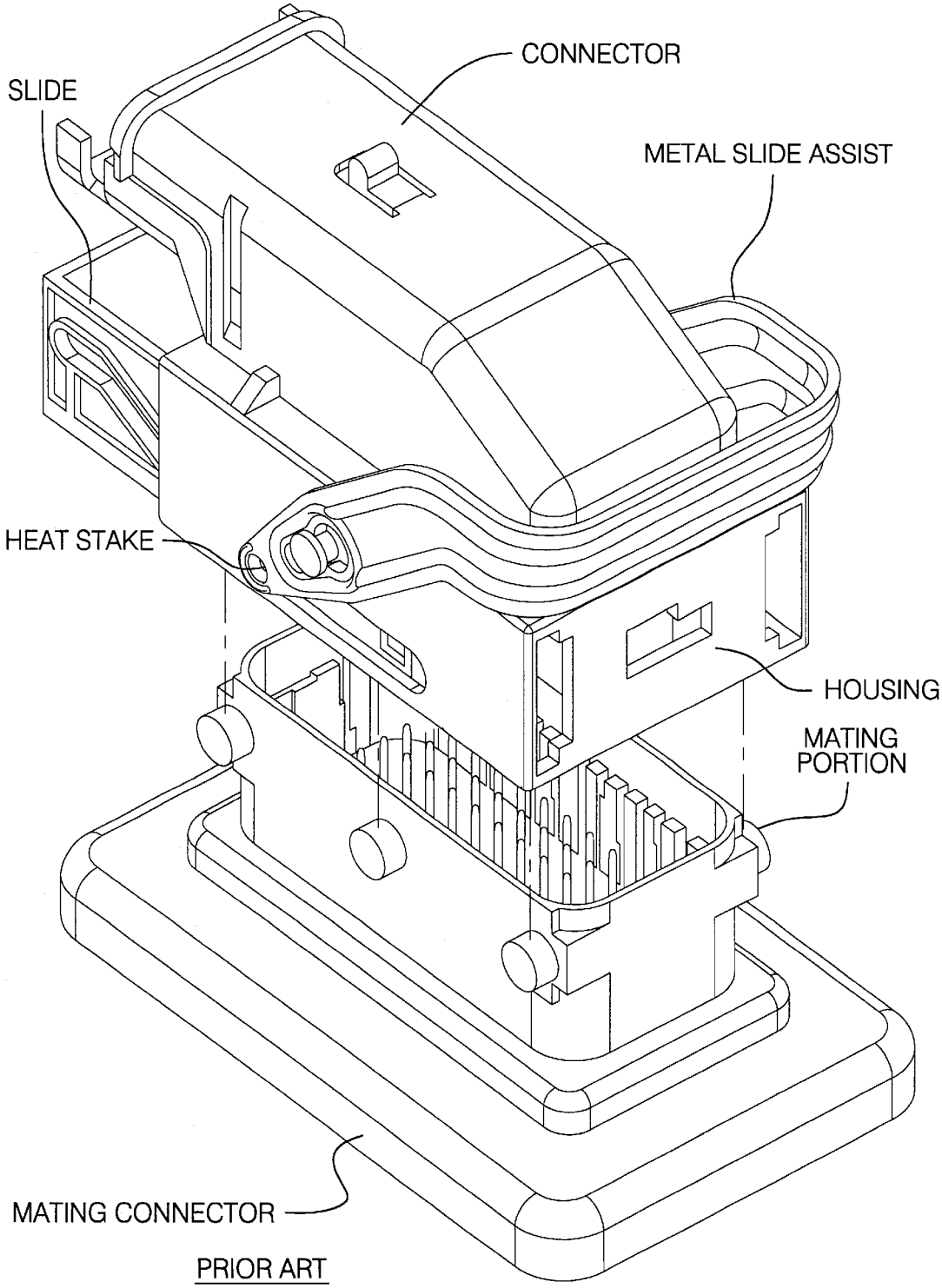
PRIOR ART FIG. 1
FIG. 1 is a perspective view of a prior art connector assembly located over a mating connector.

An electrical connector assembly of the type for mating with a mating connector is generally shown at 10 in the figures. The assembly 10 comprises: a housing 12 having spaced apart side walls 14, 16; a first slide 18 slideably supported in the housing 12 and spaced inwardly from one of the side walls 14; and a second slide 20 slideably supported in the housing spaced inwardly from the other of the side walls 16. The first and second slides 18, 20 each include at least one mating slot 22, 24, 26 adapted to receive a mating portion 28 of the mating connector 30. A slide assist lever 32 is pivotally interconnected with the housing 12 and each of the slides 18, 20 and is operable to move the slides with respect to the housing to facilitate mating with the mating connector 30. The slide assist lever 32 has a first arm 34 and a spaced apart second arm 36, the first arm extending between the first slide 18 and the adjacent side wall 14 of the housing 12, and the second arm 36 extending between the second slide 20 and the adjacent side wall 16 of the housing. Finally, the housing 12 includes a first pivot pin 38 extending from one side wall 14 and engaging the first arm 34, and a second pivot pin 40 extending from the other side wall 16 and engaging the second arm 36.

Figure 2:
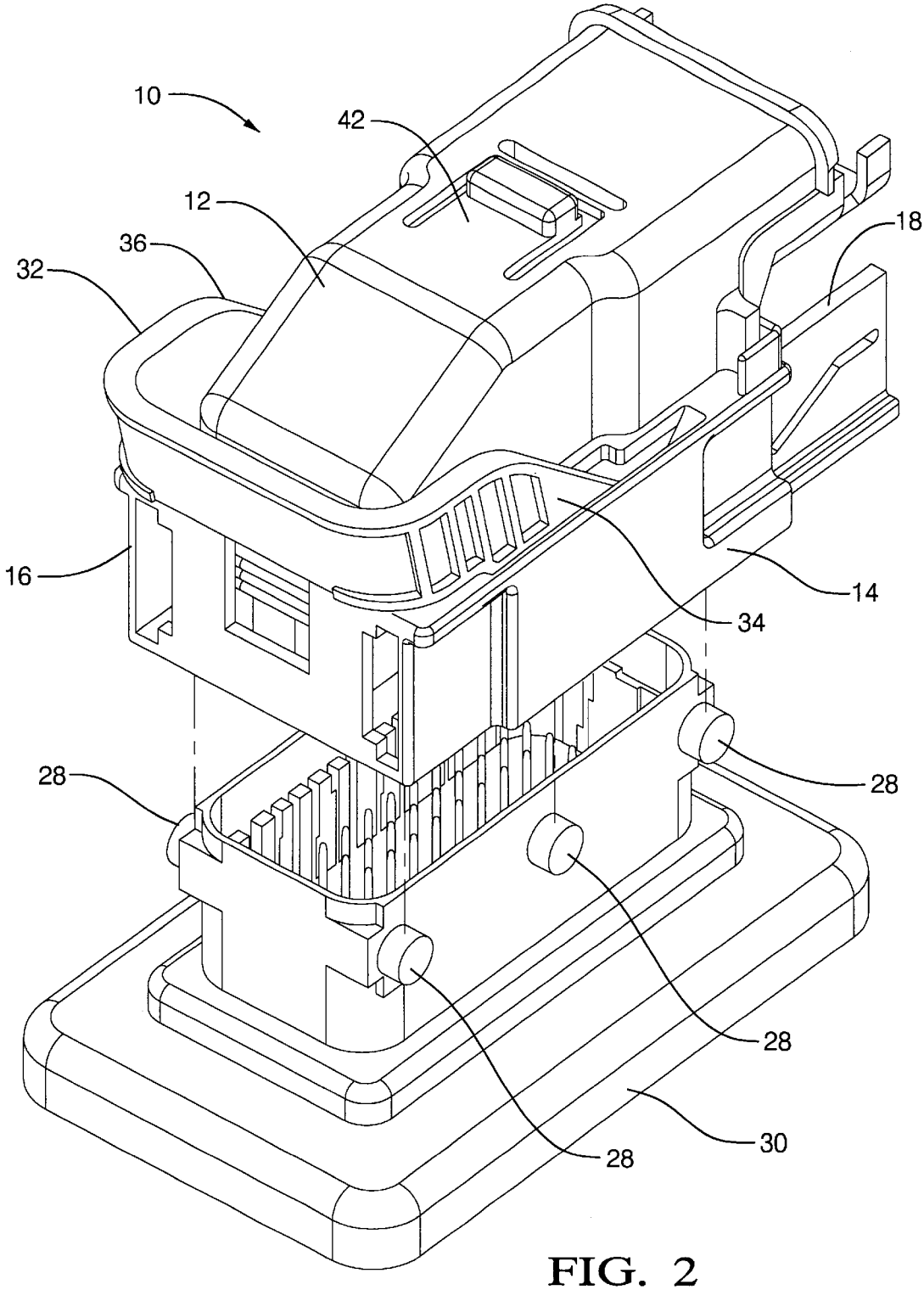
FIG. 2 is a perspective view of the present connector assembly located over a mating connector.

As shown in FIG. 2, the housing 12 generally includes a top part and a bottom part. The top part serves as a bundle cover for covering and protecting the bundle of wires that terminates in the housing. The top part is often referred to as a wire dress cover. The top part also includes a flexible top tang 42 that retains the slide assist lever 32 in its final or locked position. The top part attaches to the bottom part by means of several locking tangs (not shown) that lock the top part to the bottom part. The bottom part includes several standard features relating to the manner in which the housing receives and supports the wire bundle. Those features—for example, the terminal area 44—are not significantly related to the present inventive features and will not be discussed further. The inventive features relate more to the slides 18, 20 and the slide assist lever 32.

The bottom part of the housing includes a first track 46 slideably supporting the first slide 18, and a second track 48 slideably supporting the second slide 20. These tracks 46, 48 are shown in perspective view in FIGS. 3–7, and in cross section in FIG. 8. The tracks 46, 48 are molded as part of the bottom part. The tracks 46, 48 support the slides 18, 20—but in a position spaced away from the side walls 14, 16 of the bottom part of the housing 12.

As mentioned, the bottom part of the housing 12 includes pivot pins 38, 40 extending inwardly from each of the side walls 14, 16. Each pivot pin 38, 40 includes an enlarged head for supporting and guiding the arms 34, 36 of the slide assist lever 32.

Each arm 34, 36 of the slide assist lever includes a slide pin 50 engaging the respective slide 18, 20. Each slide pin 50 has a tapered surface 52 to facilitate engagement with the slides 18, 20 during assembly. Each of the first and second arms 34, 36 defines an elongated pivot pin slot 54, and an enlarged opening 56 at the bottom end of the pivot pin slot that is sized to receive the heads of the pivot pins 38, 40. The head of the pivot pin 38 or 40 travels in the slot 54 after being inserted through the enlarged opening 56. There is also a shallow guide slot 58 on each arm 34, 36 just below the enlarged opening 56 to provide clearance for the head of the pivot pin 38 or 40 and thereby facilitate insertion of the slide assist lever 32 into the housing 12.

Each arm 34, 36 terminates in a tip segment 60. Each arm 34, 36 includes an abutment 62 disposed adjacent the tip segment, wherein the abutment 62 extends outwardly from the tip segment 60 relative to an imaginary axis running the length of each arm 34, 36. This is illustrated quite clearly in FIGS. 3–5. In other words, the tip segment 60 is narrower than the portion of the arm 34, 36 having the abutment 62. Actually, the embodiment shown in the figures may be said to have two abutments 62, because the arm 34,36 extends outwardly on either side of the tip segment 60. The purpose of the abutment 62 will become clearer in connection with the discussion of how the slide assist lever 32 attaches to the slides 18, 20.

Each track 46, 48 defines a support slot 64 that is sized to provide clearance to the tip segment 60—but not the abutment 62—so that the tip segment 60 passes through the support slot 64 until the abutment 62 abuts the track 46, 48. The support slot 64 may be viewed as an interruption in the track 46, 48.

The housing 12 defines a deflection slot 66 adjacent the support slot 64. The deflection slot 66 is contiguous with the support slot 64 as shown in the Figures. The purpose of the deflection slot 66 is to allow the side walls 14, 16 of the housing 12 to deflect outwardly when the slide assist lever 32 is mated to the slides 18, 20 during assembly.

Each slide 18, 20 includes three mating slots 22, 24, 26. The shape and purpose of these slots are well-known. As shown in the Figures, two of the slots 24, 26 have something like an arcuate arrangement with a width dimension slightly greater than the width of the mating portion 28 on the mating connector 30. The third slot 22, located at the front of the slide 18, 20, has a shape somewhat like the other two. As each slide 18, 20 moves, it draws the mating portion 28 from a beginning point at the mouth of the slot to an ending point at or near the opposite end of the slot. This action—which is essentially a camming action—draws the mating connector 30 tighter against the connector assembly 10 and retains it in this tight relationship.

In the present invention, the slides 18, 20 have been improved to include a retaining rib 68 that extends across at least a portion of the two rear mating slots 24, 26 in the slides 18, 20. The retaining rib 68 is located near the mouth of the slot 24, 26. The purpose of the rib 68 is two-fold. First, it lets the assembler know when the mating portion 28 of the mating connector 30 is in proper position to begin sliding the slides 18, 20. As the operator inserts the mating portion 28 into the slot 24, 26, it will snap into place and let the operator know by touch that the mating portion 28 is in position. Second, the rib 68 retains the mating portion 28 in place while the assembler slides the slides 18, 20 with the slide assist lever 32. This makes assembly easier.

Each slide 18, 20 has also been improved to define a mating pin hole 70 for the slide pins 50 on the slide assist 32. The pin hole 70 is deep enough to receive the slide pin 50. The pin hole 70 is spaced above the bottom of the slide 18, 20 as shown in the Figures. The pin hole 70 is actually at the top end of a pin slot 72 defined in the slide 18, 20. Just beneath the pin hole 70, in the pin slot 72, the slide 18, 20 is formed to define a ramp or taper 74 to allow easy insertion of the slide pin 50 into the pin hole 70. The pin slot 72 is flared at either side on the bottom—also to facilitate assembly.

All of the component pieces—including the slide assist lever 32—are made from a suitable injection molded plastic.

There is also a corresponding method for assembling an electrical connector 10 that includes a housing 12 for supporting a plurality of wires, first and second slides 18, 20, and a slide assist lever 32 that is pivotally interconnected with the housing 12 and the slides 18, 20 for moving the slides 18, 20 with respect to the housing 12. In its most basic form, the method includes the steps of: inserting the arms 34, 36 of the slide assist lever 32 into the housing 12 to a predetermined assembly position; supporting the slide assist lever 32 in the assembly position with a portion 64 of the housing 12; inserting the slides 18, 20 into the housing 12; and moving the slide assist lever 32 from the assembly position into engagement with the slides 18, 20 wherein a portion of each arm 34, 36 of the slide assist lever 32 mates with a portion of each slide 18, 20.

Figure 3:
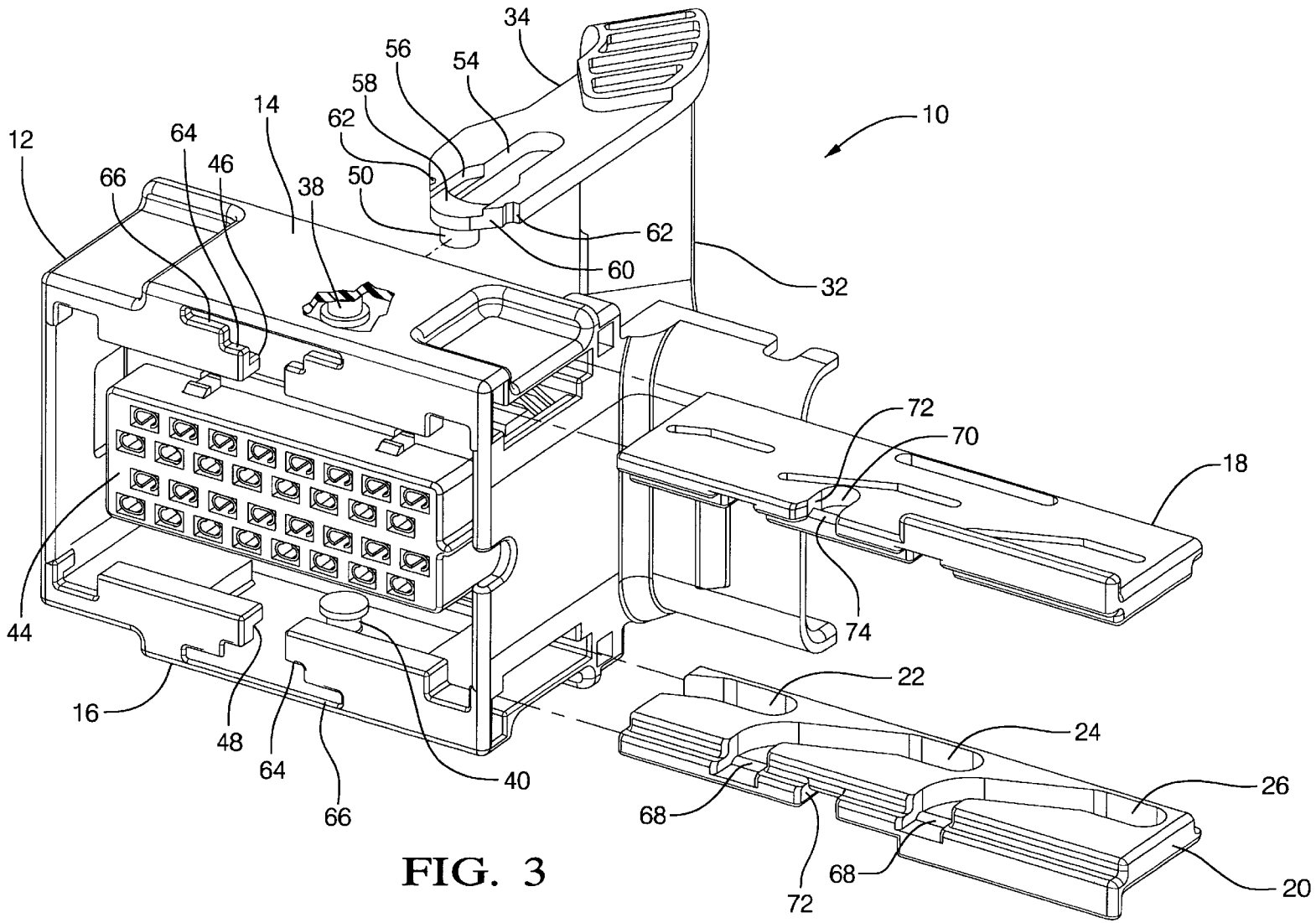
FIG. 3 is an exploded perspective view of the present connector assembly showing the bottom of the assembly.
Figure 4:
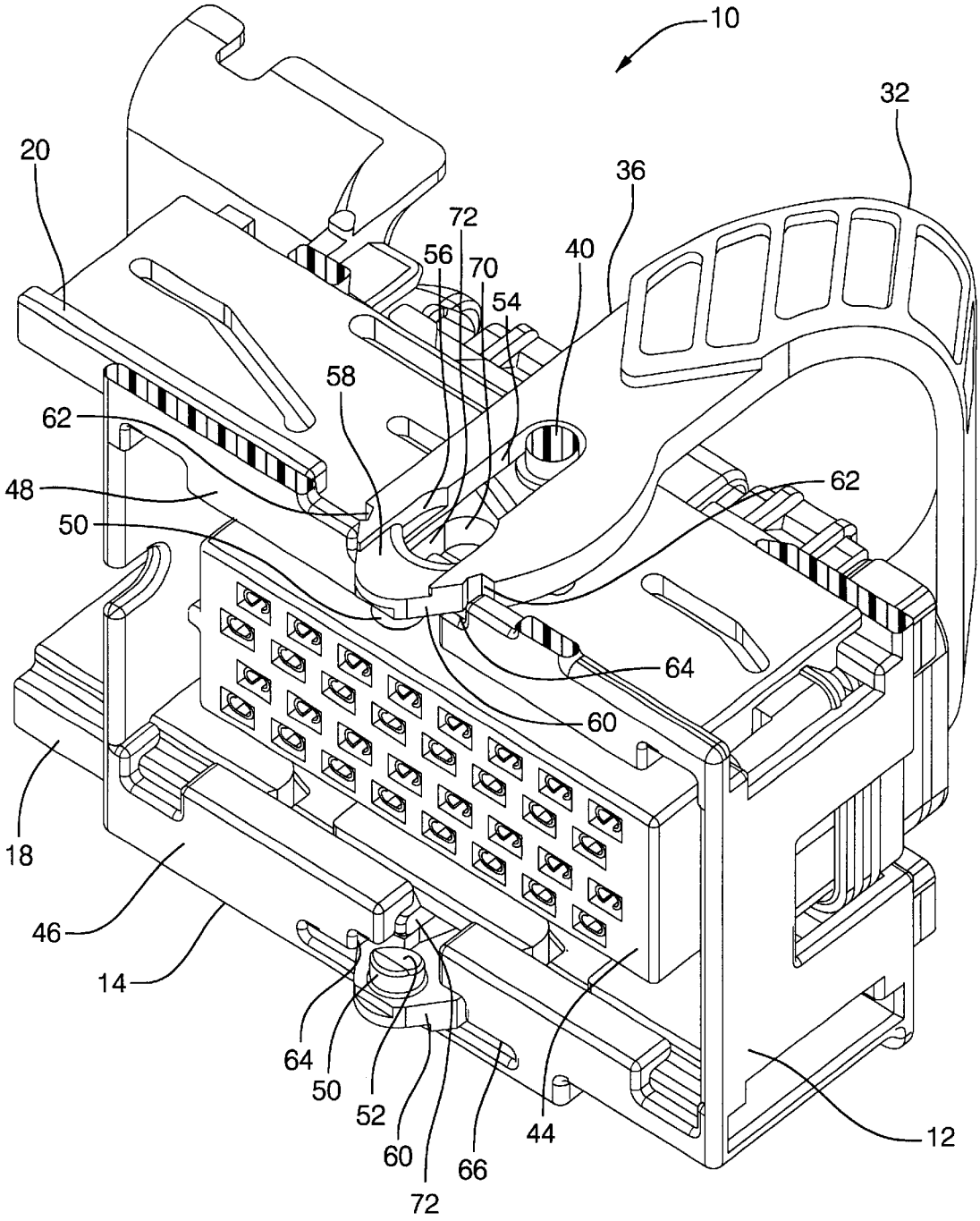
FIG. 4 is a perspective view of the bottom of the connector assembly with one side of the housing partially cut away, showing the assembly in a pre-assembled state.
Figure 5:
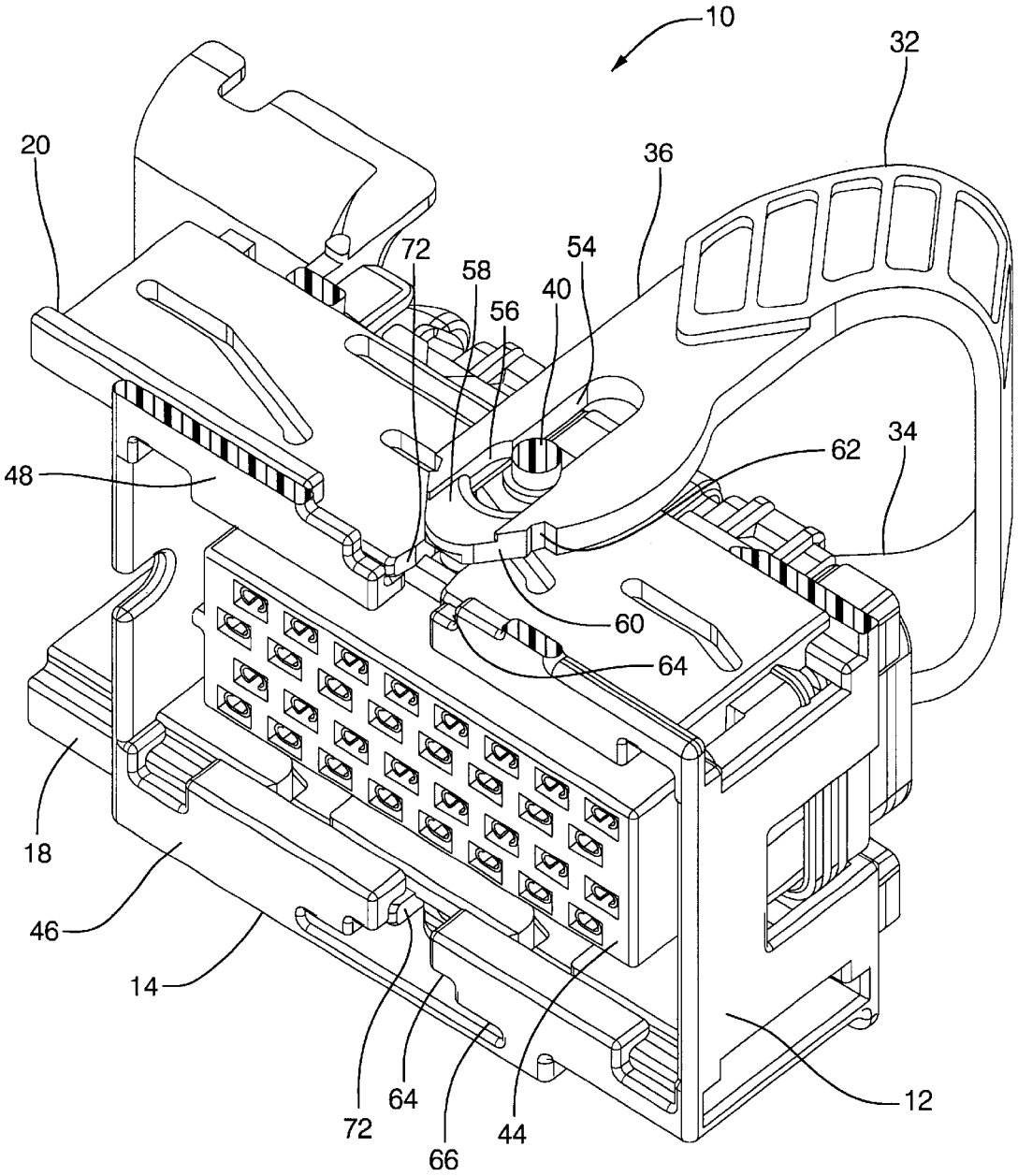
FIG. 5 is a perspective view similar to the view of FIG. 4 but with the assembly being in a fully-assembled state.

The slide assist lever 32 is inserted into the top of the housing 12 as shown in FIG. 3. As the slide assist lever 32 is being inserted, it should be manipulated to ensure that the pivot pins 38, 40 on the housing extend through the enlarged openings 56 so they can travel in the pivot pin slots 54. As shown in FIG. 4, the slide assist lever 32 is inserted into the housing 12 to the point where it is supported in an assembly position by the housing. Specifically, the tip segments 60 of the slide assist lever 32 fit into the support slots 64 defined by the tracks 46, 48. The abutments 62 on the slide assist lever 32 prevent the slide assist lever from being inserted too far into the housing. In the assembly position, the slide assist lever 32 is held so the arms 34, 36 are roughly perpendicular to the length of the housing 12.

At this point, the slides 18, 20 should be inserted into the housing 12 through the rear end of the housing. The slides 18, 20 are inserted until the pin slots 72 align with the slide pins 50. Then the slide assist lever 32 is pulled to draw each pin 50 into its respective pin slot 72, up the ramp 74, and into the pin hole 70. While this happens, the housing side walls 14, 16 deflect outwardly to allow each pin 50 to move up the ramp 74 and into its respective pin hole 70.

There are various other assembly operations having to do with inserting the wire bundle. Those operations are well-known, and in any event are beyond the scope of the invention.

Figure 6:
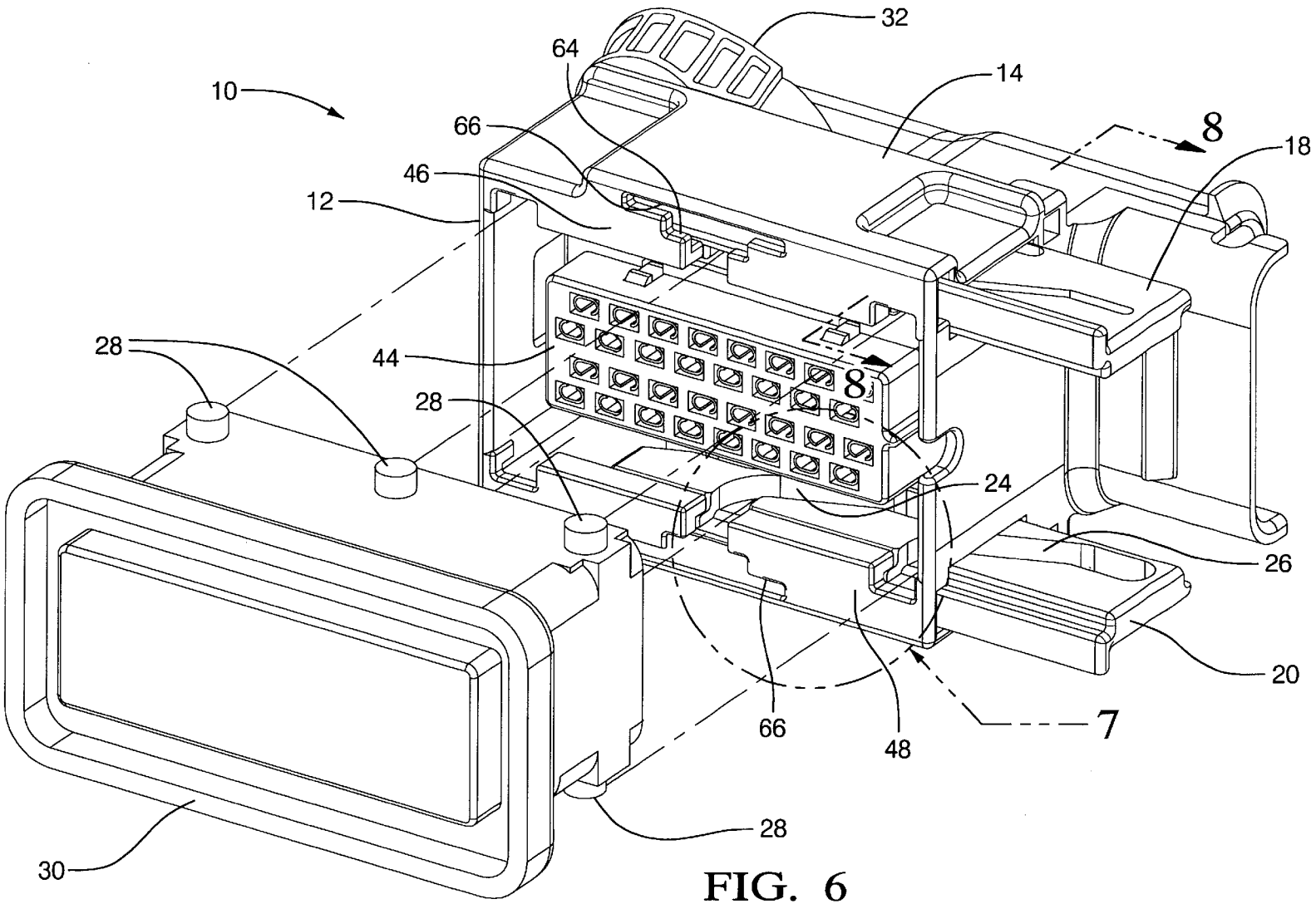
FIG. 6 is a bottom perspective view of the assembly showing how a mating connector connects to the assembly.
Figure 7:
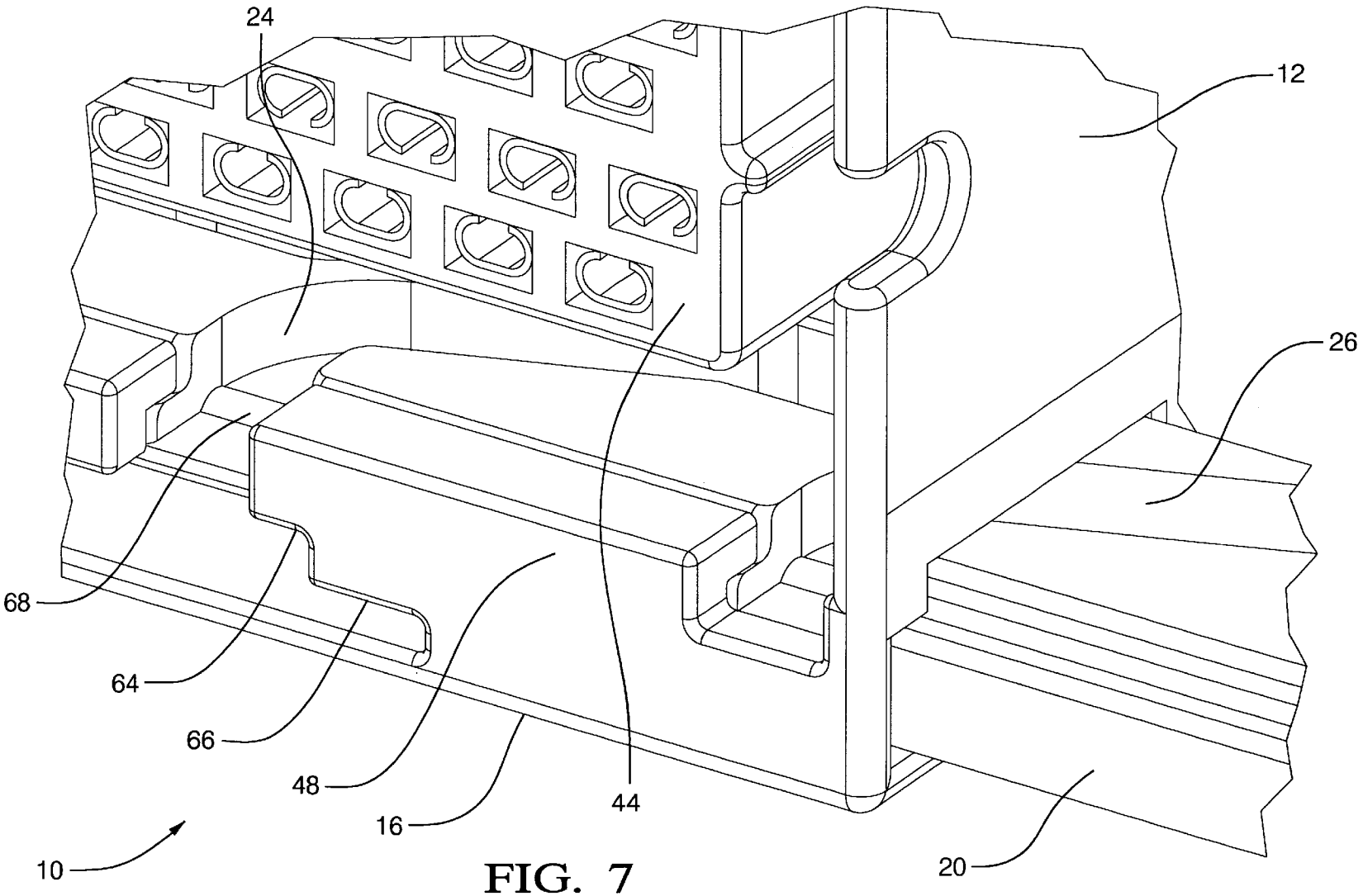
FIG. 7 is an enlarged view of the portion identified with the circle 6 in FIG. 6.
Figure 8:
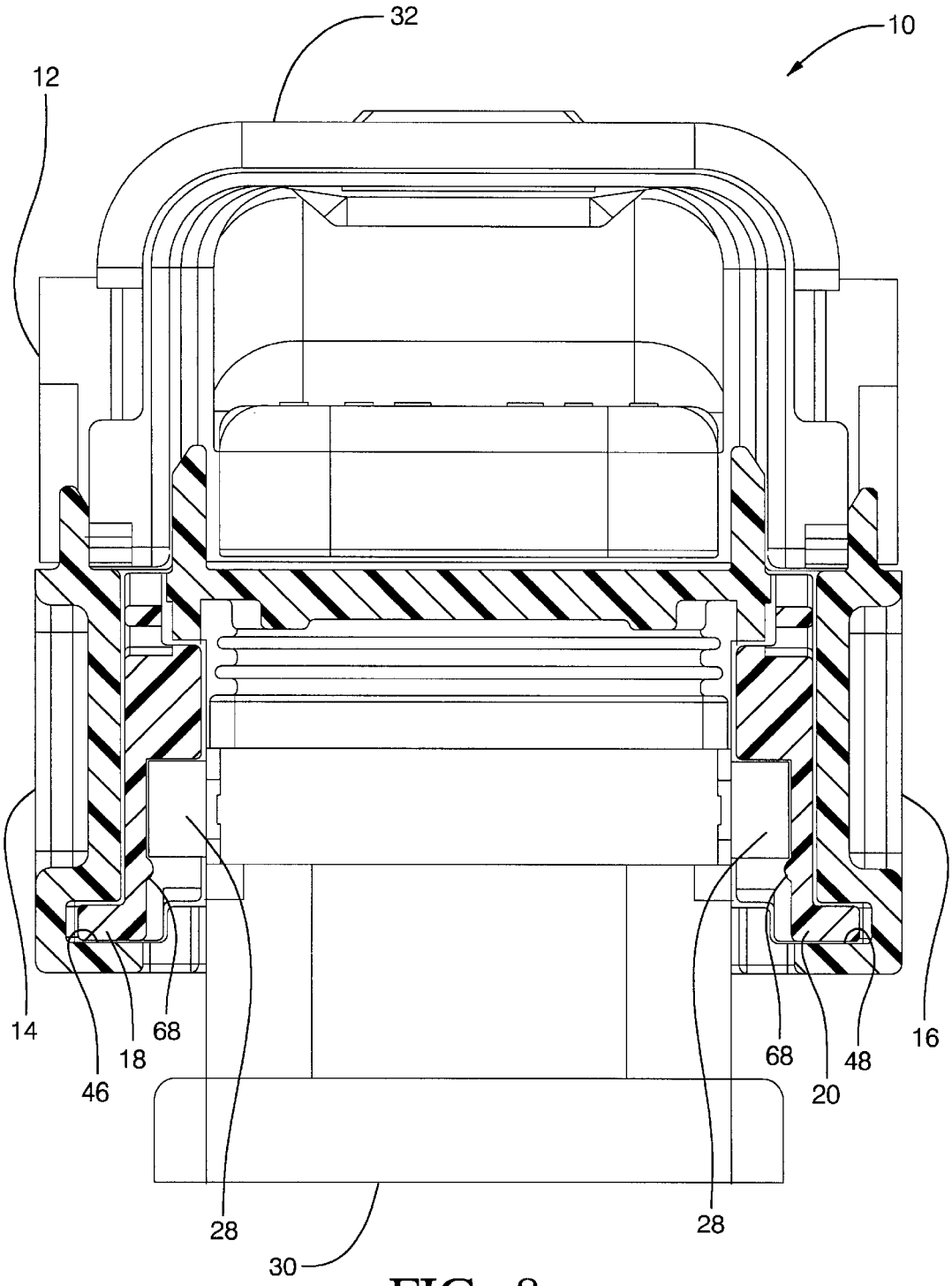
FIG. 8 is a cross-sectional view of the assembly taken along its length with the mating connector partially inserted therein.

After the connector assembly 10 is fully assembled, it can be used for its intended purpose, which is to mate with a mating connector 30. FIGS. 2, 6, and 8 show the mating connector 30 and how it connects with the connector assembly 10. The mating of the connector assembly 10 and the mating connector 30 is essentially a two step process. The first step is to insert the mating portions 28 of the mating connector 30 into the slots 22, 24, 26 past the retaining ribs 68. When the mating portions 28 are inserted to the proper extent, the assembler will feel a snap. The retaining ribs 68 then retain the mating portions 28 in anticipation of the second step. The second step involves drawing or pivoting the slide assist lever 32 back. As this happens, the mating portions 28 are cammed upwardly by the slots 22, 24, 26, thus drawing the mating connector 30 and the connector assembly 10 together. When the slide assist lever 32 reaches its final position, the top tang 42 snaps over a portion of the slide assist lever to hold it in the final position.

We claim:

1. An electrical connector assembly for mating with a mating connector comprising:

a housing having spaced apart side walls;

a first slide slideably supported in the housing and spaced inwardly from one of the side walls;

a second slide slideably supported in the housing and spaced inwardly from the other of the side walls;

the first and second slides each including at least one mating slot adapted to receive a mating portion of the mating connector;

a slide assist lever pivotally interconnected with the housing and each of the slides and being operable to move the slides with respect to the housing to facilitate mating with the mating connector, the slide assist lever having a first arm and a spaced apart second arm, the first arm extending between the first slide and the adjacent side wall of the housing, and the second arm extending between the second slide and the adjacent side wall of the housing; and the housing including a first pivot pin extending from one side wall and engaging the first arm, and a second pivot pin extending from the other side wall and engaging the second arm.

2. The assembly of claim 1 wherein each arm of the slide assist lever includes a slide pin engaging the respective slide.

3. The assembly of claim 2 wherein each slide defines a slide pin slot extending between a first end and a second end, where the first end is flared and the second end includes a pin hole, wherein the slide pin slot includes a ramped surface in the slide pin slot extending between the first end and the pin hole, and wherein each slide pin has a tapered surface to facilitate engagement with the pin holes of the slides during assembly.

4. The assembly of claim 1 further including a retaining rib extending across at least a portion of at least one of the mating slots in the slides.

5. The assembly of claim 4 wherein each slide includes three mating slots.

6. The assembly of claim 1 wherein each pivot pin includes an enlarged head, wherein each of the first and second arms define an elongated pivot pin slot, and an enlarged opening at the bottom end of the pivot pin slot sized to receive the heads of the pivot pins, and a shallow guide slot communicating with the enlarged opening at the bottom end of the pivot pin slot to facilitate receipt of the heads of the pivot pins into the enlarged openings.

7. An electrical connector assembly for mating with a mating connector comprising:

a housing having spaced apart side walls;

a first slide slideably supported in the housing and spaced inwardly from one of the side walls;

a second slide slideably supported in the housing and spaced inwardly from the other of the side walls;

the first and second slides each including at least one mating slot adapted to receive a mating portion of the mating connector;

a slide assist lever pivotally interconnected with the housing and each of the slides and being operable to move the slides with respect to the housing to facilitate mating with the mating connector, the slide assist lever having a first arm and a spaced apart second arm, the first arm extending between the first slide and the adjacent side wall of the housing, and the second arm extending between the second slide and the adjacent side wall of the housing;

the housing including a first pivot pin extending from one side wall and engaging the first arm, and a second pivot pin extending from the other side wall and engaging the second arm, the housing including a first track slidably supporting the first slide, and a second track slidably supporting the second slide, each arm terminating in a tip segment and including an abutment disposed adjacent the tip segment where the abutment extends outwardly from the tip segment relative to the axis along the length of the arm, and each track defining a support slot that is sized to provide clearance to the tip segment but not the abutment so that the tip segment passes through the support slot until the abutment abuts the track.

8. The assembly of claim 7 wherein the housing defines a deflection slot adjacent each support slot, the deflection slot being contiguous with the support slot and adjacent the one or the other side wall to allow the side walls to deflect outwardly when the slide assist lever is mated to the slides.

9. An electrical connector assembly for mating with a mating connector comprising:

a housing having spaced apart side walls;

a first slide slideably supported in the housing near one of the side walls;

a second slide slideably supported in the housing near the other of the side walls;

the first and second slides each including at least one mating slot adapted to receive a mating portion of the mating connector;

a slide assist lever pivotally interconnected with the housing and each of the slides and being operable to move the slides with respect to the housing to facilitate mating with the mating connector, the slide assist lever having a first arm pivotally connected to the first slide and a spaced apart second arm pivotally connected to the second slide;

the housing including a first pivot pin extending from one side wall and engaging the first arm, and a second pivot pin extending from the other side wall and engaging the second arm; and a retaining rib extending across at least a portion of each of the mating slots in the slides.

10. A method for assembling an electrical connector that includes a housing for supporting a plurality of wires, first and second slides, and a slide assist lever having arms that are pivotally interconnected with the housing and the slides for moving the slides with respect to the housing, the method including the steps of:

inserting the arms of the slide assist lever into the housing to a predetermined assembly position;

supporting the slide assist lever with a portion of the housing in the assembly position;

inserting the slides into the housing;

moving the slide assist lever from the assembly position into engagement with the slides wherein a portion of each arm of the slide assist lever mates with a portion of each slide.

11. The method of claim 10 wherein the slides are inserted into the housing so that each arm of the slide assist lever is between the slide and the housing.

12. The method of claim 10 wherein the step of moving the slide assist lever into engagement with the slides includes the step of disposing a pin on each arm of the slide assist lever into respective mating holes in the slides.

13. The method of claim 12 including the step of aligning the mating holes in the slides with the pins on each arm prior to moving the pins into engagement with the mating holes.

* * * * *